United States Patent [19]

Zanders

[11] 3,961,793

[45] June 8, 1976

[54] EDUCATIONAL AND RECREATIONAL GAME

[76] Inventor: Willie M. Zanders, 2725 Soniat St., New Orleans, La. 70115

[22] Filed: Jan. 30, 1974

[21] Appl. No.: 438,019

[52] U.S. Cl. ..... 273/124 R; 35/34; 273/6; 273/121 R

[51] Int. Cl.[2] ..... A63D 13/00

[58] Field of Search ..... 273/2, 3 A, 5 R, 5 A, 273/5 B, 6, 11 R, 118 R, 119 R, 120 R, 121 R, 122 R, 123 R, 124 R, 125 R, 3 C, 11 C; 35/28, 34

[56] References Cited

UNITED STATES PATENTS

| | | | |
|---|---|---|---|
| 207,835 | 9/1878 | Witsil | 273/123 R |
| 683,566 | 10/1901 | Meyers | 273/124 R |
| 1,971,295 | 8/1934 | Calaluca | 273/5 R UX |
| 3,743,288 | 7/1973 | Danklefsen | 273/6 |
| 3,825,258 | 7/1974 | Frierman | 273/2 |
| 3,829,097 | 8/1974 | Rohrmuller | 273/125 R |

FOREIGN PATENTS OR APPLICATIONS

| | | | |
|---|---|---|---|
| 106,313 | 1/1967 | Denmark | 273/3 C |
| 320,404 | 10/1929 | United Kingdom | 273/3 A |

OTHER PUBLICATIONS

Billiards for Everyone by Luther Lassiter and George Sullivan, Grosset and Dunlap, Feb., 1972, p. 49.

*Primary Examiner*—Richard J. Apley
*Assistant Examiner*—Richard T. Stouffer
*Attorney, Agent, or Firm*—Pugh & Keaty

[57] ABSTRACT

An educational and recreational game having a case-like rectangular basic structure including an outer support structure and an interior frame with interchangeable principal transparent playing elements and insertable underlying complementary transparent elements which upon insertion change the style of recreational play and introduce various mathematical relationships represented by lines on the elements into the game. The complementary elements or inserts singularly and collectively form a series of mathematical figures which are used in basic and advanced mathematics and are used in the game for instructional purposes. There are several circular openings in the principal playing surfaces with associated arch-shaped, cylindrical targets and stops located atop the principal playing surfaces. Structure is provided for retrieving the balls which roll upon the principal playing surface. In use, balls are manually propelled across the principal playing surface, and, ideally, after striking a peripheral, multi-purpose frame or structural support, roll into one of the circular openings if the ball was propelled along the lines on the complementary elements. Points, line segments, various types of angles, triangles, hexagons, parallelograms, and other polygons are some of the mathematical representations utilized in the game.

9 Claims, 12 Drawing Figures

EDUCATIONAL AND RECREATIONAL GAME

BACKGROUND OF THE INVENTION

This invention relates in general to educational and recreational games in which balls are rolled into openings disposed about a flat playing surface and more specifically to the structure of the game and its method of use for certain recreational and/or educational ends.

It is of course well known in the prior art to have games which utilize balls propelled by means of a shooter mechanism over a playing surface, the balls being dropped through holes or passed through channels to score certain points, and these types of games have generally been called pin ball games. The present invention is directed to a new form of this type of game which can be utilized for recreational and educational purposes.

The educational and recreational game apparatus of the present invention includes inter alia a rectangular, outer structure which supports a main or principal playing surface element at an upper level while one or more underlying complementary elements are removably located at lower levels. To the inventor's knowledge no other game of a comparative nature has been so constructed as the present invention which utilizes the above generally described structure and which further includes a unique series of geometric figures which are readily adaptable and extraordinarily appropriate for the teaching of basic and advanced mathematics.

Additionally, the present invention can more than adequately provide genuine entertainment for all members of the family. The educational and recreational utility of this invention extends to persons of all ages, including those whose prior mathematical background may be minimal.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

All of the other figures.

FIG. 5 – a first, basic embodiment of the interchangeable principal playing surface;

FIG. 6 – a second, advanced embodiment of the interchangeable principal playing surface (not heretofore illustrated);

FIG. 7 – a first, exemplary embodiment of the complementary playing element;

FIG. 8 – a second, exemplary embodiment of the complementary playing element;

FIG. 9 – a third, exemplary, advanced embodiment (not heretofore illustrated) of the complementary playing element;

FIG. 10 – a shooter accessory for use in propelling the ball on the principal playing surface;

FIG. 11 – an accessory strip for providing a "number line" and

FIG. 12 – a straight corner strip or backboard accessory.

DESCRIPTION OF THE PREFERRED EMBODIMENTS

As illustrated particularly in FIGS. 1–4, the preferred embodiment of the educational and recreational game apparatus of the present invention includes in its construction an outer generally rectangular support structure 1 and interior frame 2 with an interchangeable principal playing surface 3 and two underlying, complementary playing elements 4.

Figure 5:
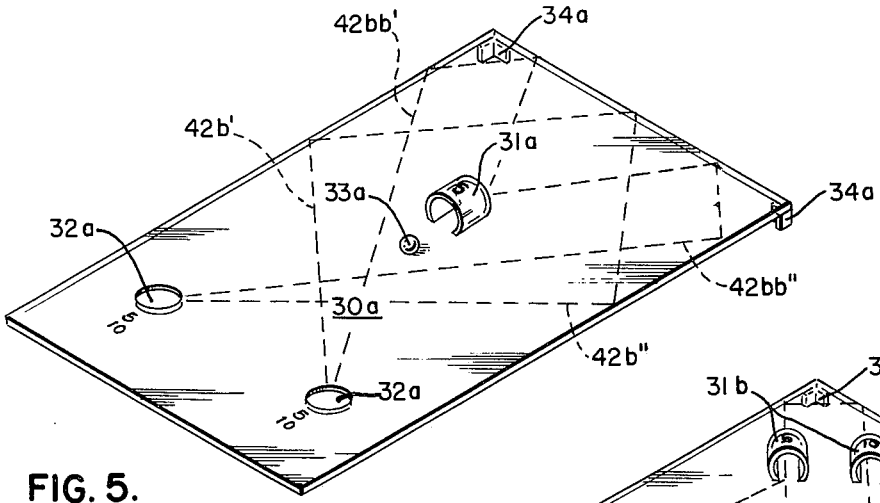
Figure 6:
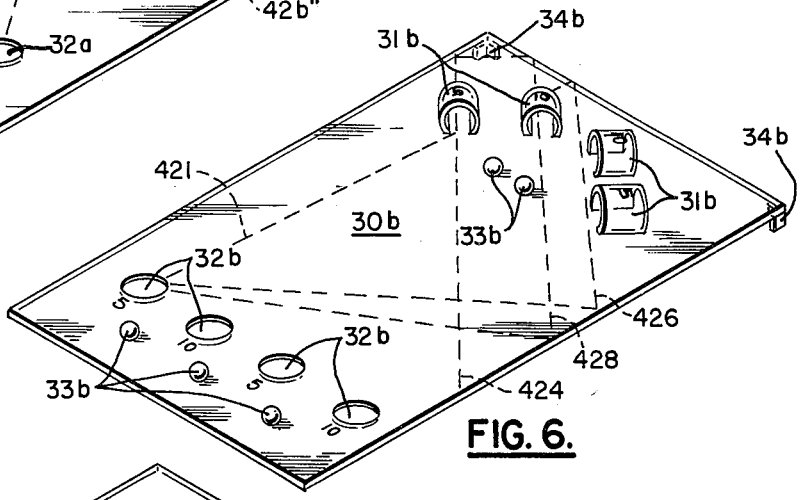

The principal playing surface 3 may be for example either the basic version **30*a* illustrated (note also FIG. 5) or the advanced version 30*b* (FIG. 6**).

The first embodiment of the basic principal playing surface **30*a* illustrated in FIG. 5 has an arch-shaped cylindrical target 31*a*, which can be either removably or non-removably mounted atop its surface, and two circular openings 32*a* flush within the playing surface. Balls 100 which are hand launched, or alternatively mechanically launched by a suitable shooter (note FIG. 10), are to roll through the cylindrical openings 32*a*** in order that points may be scored by the players.

A spherical barrier **33*a* is placed atop the surface to prevent a player from rolling balls directly through the arch shaped cylindrical target 31*a*. Because of the barrier 33*a* more skill is required on the part of the players since the ball must first strike one of the side peripheral frame or structural support edges 11 in an angular direction. However, points may also be scored by rolling the ball in a straight line against the back frame 12 and into one of the circular openings 32*a*** for fewer points.

The second embodiment or advanced principal playing surface **30*b* illustrated in FIG. 6 has four arch-shaped cylindrical targets 31*b* on its surface and four circular openings 32*b* flush within the surface. Spherical barriers 33*b*** are provided to add excitement and greater challenge to the playing action.

Both positive and negative points can be assigned to certain openings disposed about the principal playing surface.

The principal playing surfaces 3 are equipped with prongs **34*a*, 34*b* at the two upper corners. These prongs 34*a*, 34*b* plug into openings 21 on the corresponding corners of the interior frame 2. Such connection allows for the principal playing surfaces 3** to be firmly attached but still easily removed.

Figure 2:
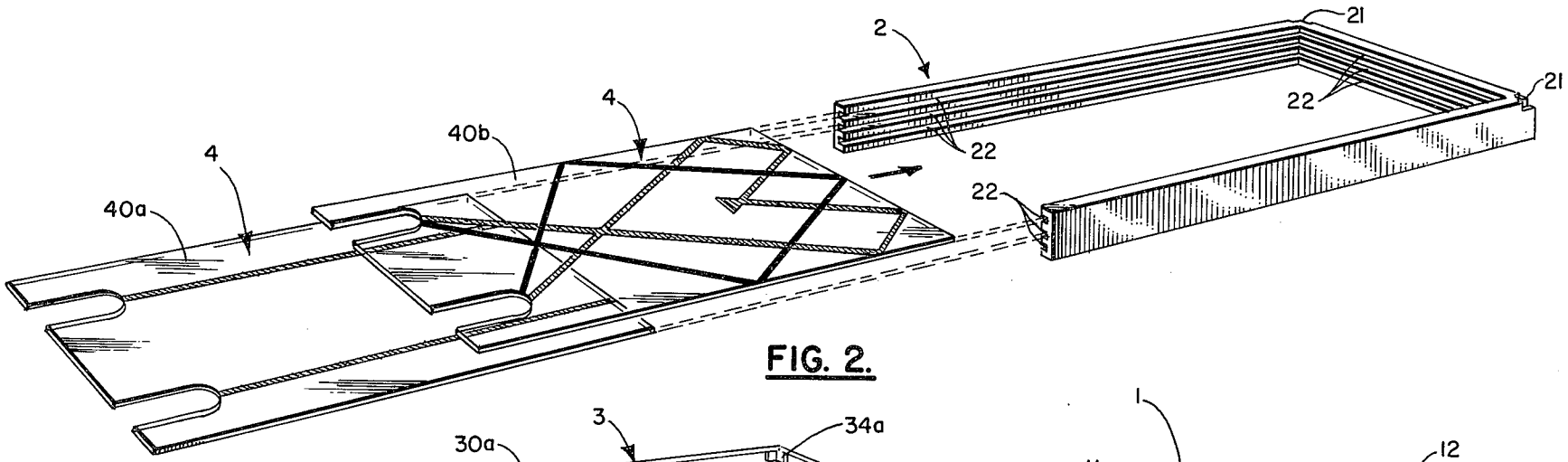
FIG. 2 is a perspective view of the interior frame, with the two, interchangeable complementary elements being shown in "exploded" array, of the embodiment of FIG. 1.
Figure 4:
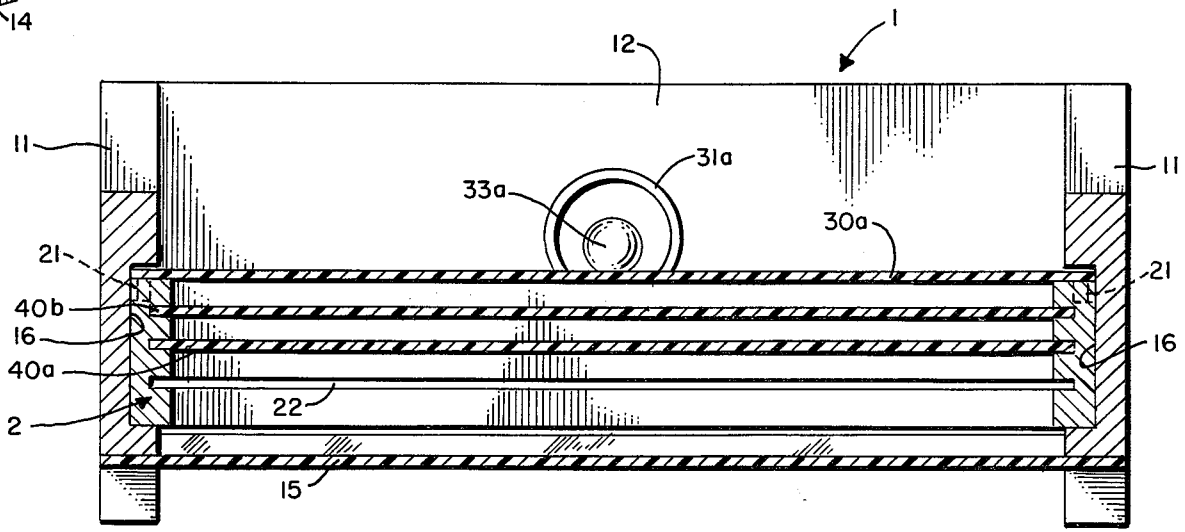
FIG. 4 is a cross-sectional view of the preferred embodiment, taken along section lines 4—4 of FIG. 3, with the accessory of FIG. 3 not included.

The interior sides of inner frame structure 2 are provided with grooves 22 which support the insertable and removable complementary elements 4 (note particularly FIGS. 2 and 4). The inner frame 2 in turn is inserted into the multipurpose outer frame or basic structure support 1.

The basic support structure 1 has several functions. It provides: (a) an enclosure to contain the launched ball and against which the ball strikes, (b) a structure with inner grooves 16 parallel with its sides for holding the interior frame structure (note particularly FIGS. 1 and 4) and (c) a means to support the ball receiving and holding tray 5. The latter is removable and, because of its construction with wider side pieces and its location, serves to hold the underlying complementary surfaces 4 in their proper position. The removable tray 5 is fixed to the bottom end of the basic support structure 1 by means of male pins 13 which mate with female holes in the edges of the basic frame 1. Side ball receiving compartments 14 are provided in the tray 5 to extend pass both side edges of the basic frame 1 (note FIG. 3). The basic frame 1 has a "partial bottom" 15 (note FIG. 1) which extends under and leads to the removable ball receiving tray 5.

Figure 7:
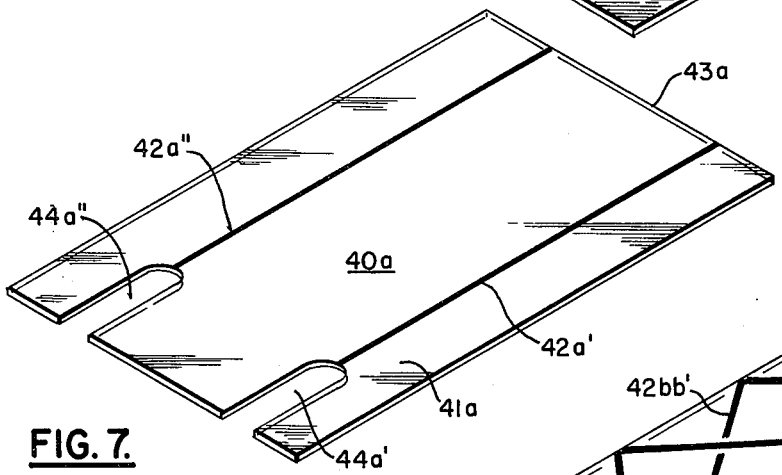
Figure 8:
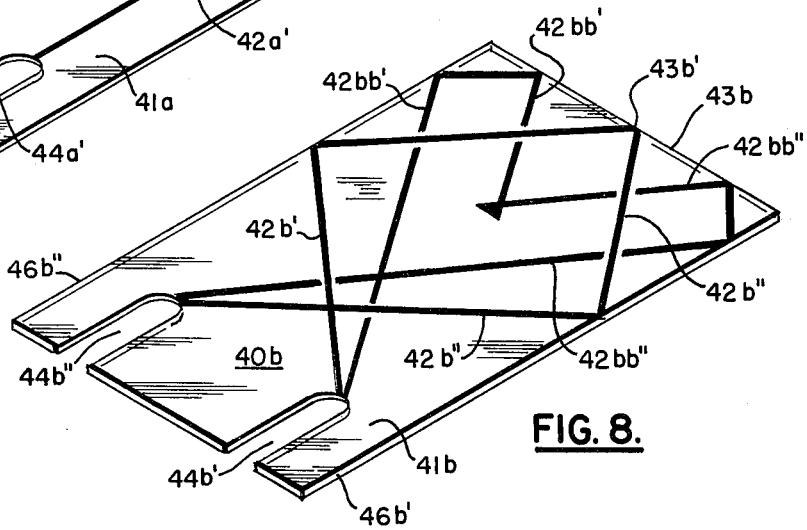
Figure 9:
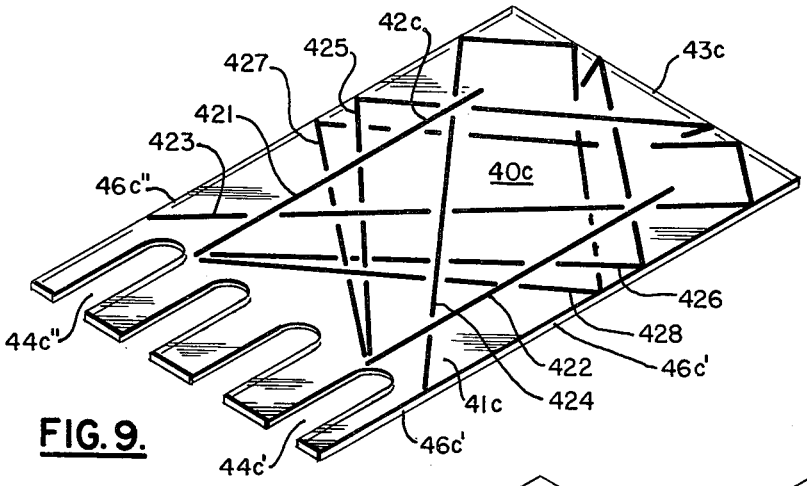

The underlying complementary surfaces or elements 4 can be of many different forms, and, for purposes of illustration, three different embodiments will be described with particular reference to FIGS. 7, 8 and 9.

The first embodiment 40*a* (note FIG. 7) has on its surface 41*a* two parallel strips 42*a*' 42*a*'' of for example plastic or some other suitable material. The strips 42*a*', 42*a*'' run perpendicular to the back side 43*a*, one strip 42*a*' being aligned with elongated opening 44*a*' and the other 42*a*'' with elongated openings 44*a*''. Two right angles are thus formed between the lines 42*a*', 42*a*'' and the backside 43*a*. A third strip (not illustrated) can be placed at the upper central section of the surface 41*a* along the back side 43*a* to positively illustrate the two right angles formed with the other two strips 42*a*', 42*a*''. The first embodiment 40*a* of the underlying complementary surface 4 thus illustrates the characteristics of perpendicular or right angle figures and relationships.

The second embodiment 40*b* (note FIG. 8) of the underlying complementary surface 4 also utilizes several strips of plastic or some other suitable material. Strip 42*b*' originates at elongated opening 44*b*' and intersects side 46*b*'', thus forming two acute angles and one obtuse angle therewith. It then extends in an angular direction to the midpoint 43*b*' of back side 43*b* where two equal acute angles and one obtuse angle are formed. The strip then continues as line 42*b*'' until it intersects side 46*b*' at a point directly opposite its intersection of side 46*b*'' and an identical set of angles formed. The strip then terminates as line 42*b*'' at elongated opening 44*b*'' after having formed a diamondlike figure or quadrilaterial, forming two pairs of vertical angles, and several triangles. A second strip originates as line 42*bb*' from elongated opening 44*b*', and it intersects the left side 46*b*'' where three angles are formed. The strip 42*bb*'' then intersects side 43*b* and goes back to a point corresponding to where the opening of the central, arch-shaped target 31*a* is located on the principal playing surface 30*a* (note FIGS. 3 and 5). The strip as line 42*bb*'' again intersect back side 43*b* at a point to the right of elongated opening 44*b*' and then it intersects side 46*b*', where again two acute and one obtuse angles are formed. The strip 42*bb*'' then terminates at elongated opening 44*b*'' which corresponds to the location of target opening 32*a* on the basic principal playing surface 30*a*. Strip 42*bb*', 42*bb*'' thus forms among other figures, a parallelogram, several quadrilaterals, triangles and pairs of vertical angles.

The third embodiment 40*c* (note FIG. 9) of the complementary element 4 is the corresponding insert for the advanced principal playing surface 30*b* (note FIG. 6) and has many complex geometric arrangements thereon. Strip 421 is parallel and nearest to side 46*c*''. It is aligned in a manner to direct a player to roll the ball from the left-most circular opening 32*b* to a point in line with an arch-shaped target 31*b* atop the principal playing surface 30*b*. Strip 422 is similarly positioned as strip 421, yet on the opposite side of the complementary surface 41*c*, nearest side 46*c*'. The strips 421 and 422 connect the directional and formational lines 427 and 428 which originate at points slightly above the outer elongated openings 44*c* which correspond to the outer circular openings 32*b*. The strips are placed in an angular direction so that the strips 424 and 426 intersect sides 46*c*' and 43*c*, while strips 425 and 427 intersects sides 46*c*'' and 43*c*. Strips 421, 423, 425, and 427 terminate at points corresponding to the arch-shaped targets 31*b* on the advanced principal playing surface 30*b*. Strips 424, 426 and 428 are identically placed as their counterparts, strips 423, 425 and 427, except for being on the opposite side of the surface 41*c*. Strips 426 and 428 intersect sides 46*c*', 43*c* and 46*c*'', while strip 424 intersects only sides 46*c*'' and 43*c*. Strips 422, 424, 426 and 428 like strips 421, 423, 425 and 427, terminate at points corresponding to the arch-shaped cylindrical targets 31*b* atop the advanced principal playing surface 30*b*. The eight strips of the third embodiment 40*c* thus collectively form more than a hundred and fifty angles and many polygons including more than thirty triangles.

Given the various mathematical relationships inherent in the above described, three embodiments of the complementary elements 4, both general and specific mathematical concepts can be highlighted which are suitable for instructional purposes. Listed below are but a few of the many such features obtainable in the preferred embodiments of the present invention which are illustrative of its general versatility: (1) points, (2) line segments, (3) parallel lines, (4) perpendicular lines, (5) angles, in general, (6) acute angles, (7) equal angles, (8) obtuse angles, (9) vertical or right angles, (10) adjacent angles, (11) triangles, and (12) other polygons.

For purposes of added clarification, samples of the guide lines on the complementary elements 4 have been indicated by phantom lines on the principal playing surface 3 in FIGS. 5 and 6 to indicate the location of where they would appear when viewed through the transparent playing surface 3. In particular guide lines 42*b*', 42*b*'', 42*bb*', and 42*bb*'' have been phantomed lined on playing surface 30*a* of FIG. 5, and guide lines 421, 424, 426 and 428 on playing surface 30*b* of FIG. 6.

Figure 11:
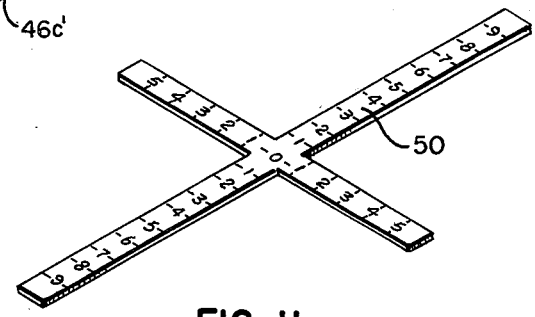

In adding points as part of the recreational play, one gets practice computing both positive and negative numbers. For example, where a player first scores twenty points in a target on the third embodiment 40*c* of the complementary element 4 and should the same ball roll into a circular opening assigned for example ten points, the actual score for that particular launched ball would be "ten." To make the scoring process more easily understood by the younger players or students an "added-on" line accessory 50 (note FIG. 11) can be utilized. Subtraction, division, multiplication and addition can be performed using the number line 50. Furthermore, one can become more knowledgable about graphing points on a plane when the number line 50 is for example printed or included on one of the complementary inserts 4.

Figure 12:
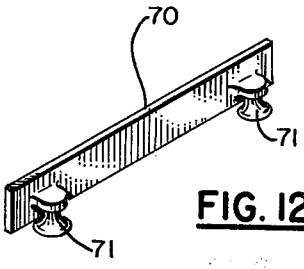

Some of the other possible embodiments of exemplary "added-on" or accessory features are for example the curved strip 60 (note FIG. 3) and the straight strip 70 (note FIG. 12). These strips 60, 70 of plastic or some other suitable material can be positioned in the back end or corners, respectively, of the device and thereby relocate the action on the principal playing surface 3 by preventing the ball from striking the rectangular back corners of the frame edges 11, 12 but instead hitting the curve shaped strip 60 or the straight strip 70. Suction cups 61, 71 can be attached to the strips 60, 70, respectively for fastening the strips to the principal playing surface 3. Additional complementary elements having suitable strips thereon to properly indicate the new paths caused by the addition of the strips 60, 70 could be utilized.

For additional educational and recreational purposes, the present invention also allows for the inclusion of "puzzle pieces" corresponding to the actual size of each geometric figure represented on the complementary surfaces 4. The type of geometric figure and corresponding degrees of the respective angles can be labeled on each "puzzle piece." One's ability to recognize angles, and other geometric figures will be greatly enhanced by this addition. These aspect of the present invention will afford one the use of protractors and other such mathematics paraphernalia to measure and compare angles.

Figure 10:
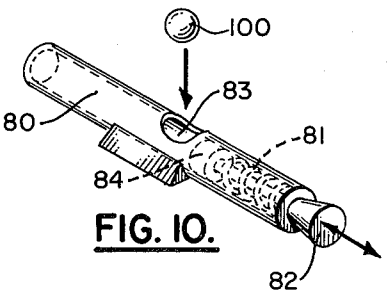
FIGS. 5–12, are perspective views of the various elements, some in multiple embodiments, and accessories of the preferred embodiments of the educational and recreational game of the present invention, as outlined below.

A suitable shooter accessory for mechanically propelling the ball 100 across the principal playing surface 3 is illustrated in FIG. 10. The shooter comprises a cylindrical barrel 80 having a ball receiving aperture 83 in its upper surface. Pull actuating handle, which is biased inwardly by spring 81, can be used to strike the ball 100 with striking surface 84 in the well-known way.

The game 1 sits on legs which are longer at the upper, top of the game so that the principal playing surface 3 and complementary elements 4 have a slight incline to them. Hence a ball rolling on these surfaces have a tendency to roll down the surface under the force of gravity. This action gives a slight bias to the roll and path of the ball as it traverses the surface, which becomes particularly effective when the ball begins to slow down and is traveling at an angle to the longitudinal axis of the surface. Hence, in order for a player to hit a target, not only is the direction of propulsion of the ball important, but often also the force of propulsion, the ball sometimes being "dropped" into the target. This bias adds a "ball disturbing" factor which further adds to the excitement and challenge to the game.

Figure 3:
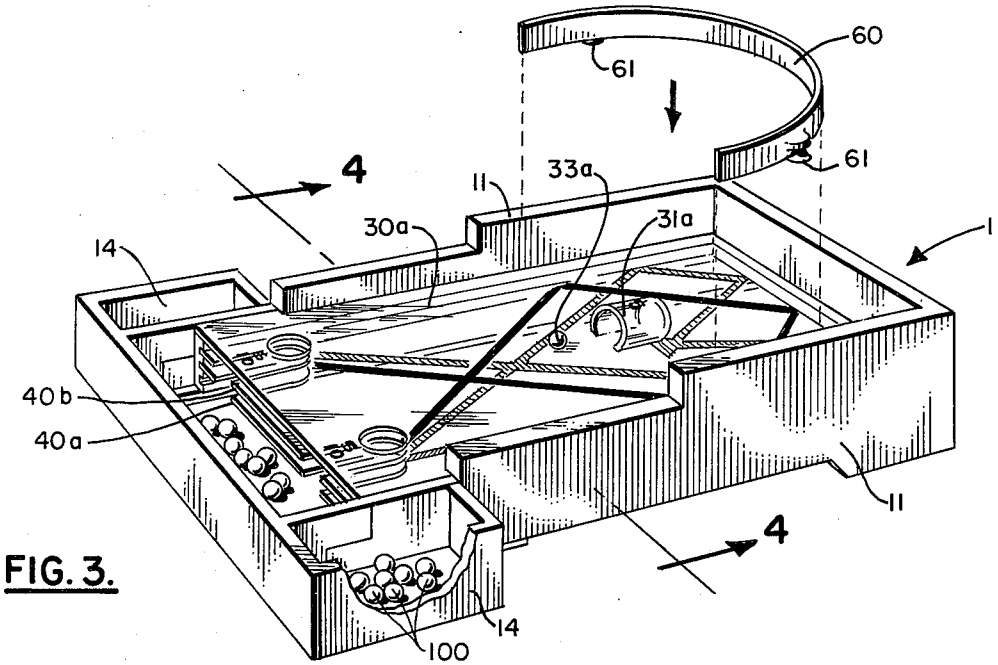
FIG. 3 is a perspective view of the fully assembled game of the preferred embodiment of the present invention with an accessory (a curved peripheral backboard) shown in "exploded" array.

As shown in FIG. 3, the elongated, terminal slots 44*a'*, 44*a''*, 44*b'*, 44*b''* in the complementary elements 4 line up with the circular holes or targets 32*a* of the principal playing element 3. This structure, which is an important feature, allows the ball to drop through the target and the ball return, and yet allows the elements 3 and 4 to be placed close together in juxtaposition.

Figure 1:
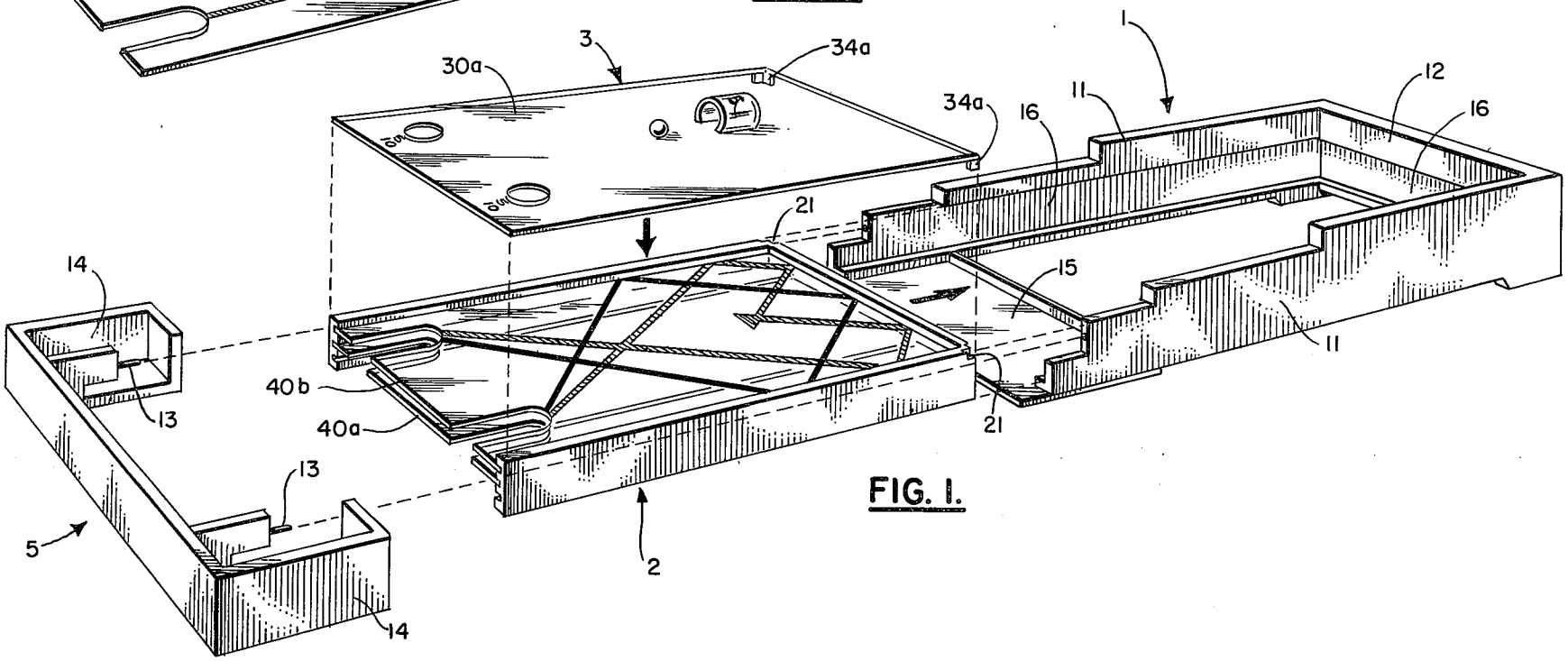
FIG. 1 is a perspective view of the preferred embodiment of the present invention, showing some of the structural elements thereof in "exploded" array, including the basic outer support structure, the interior insertable frame supporting two, interchangeable complementary elements, an interchangeable principal playing element, and an associated ball receiving tray.

It is noted that multiple complementary surfaces 4 can be used as illustrated in FIGS. 1–3, or only one used as desired, enhancing the flexibility of the game. Additionally, rather than using legs 34*a* and placing the element 3 down into the game, a slot (analogous to slots 22) could likewise be provided for it.

Preferably the interior frame 2, principal playing surfaces 3 and underlying complementary surfaces or elements 4 are formed from transparent plastic, such as "plexiglass," or any other suitable material. The outer frame or structural support 1, spherical barriers, 33*a*, 33*b*, ball receiving tray 5 and archshaped cylindrical targets 31*a*, 31*b*, can also be formed from plastic, such as "plexiglass" (preferably colored), or some other suitable material.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. An educational and recreational game comprising:

a basic support frame;

at least one principal playing surface element of transparent material mounted on said support frame having targets mounted thereon and on which balls are rolled at said targets;

a multiple number of interchangeable complementary playing elements, each having different sets of path lines disposed thereon associated with said principal playing surface element; each set of path lines on said complementary elements being keyed to said targets and used to show the path which the ball should travel on said principal playing surface element to hit said targets and designed to illustrate certain geometrical relationships and/or figures;

said complementary playing elements being made of transparent material, at least two of them being usable in said game at the same time, the complementary playing elements being located when in use beneath said principal playing surface element, said path lines of each of said complementary playing elements when in use being visible through said transparent material of said principal playing surface element and any of said complementary playing surface elements positioned thereabove.

2. The game of claim 1 wherein said at least one of said targets comprises a hole in said principal playing surface, the ball when hitting said target dropping through said hole down into said upper one of said complementary surfaces, at least the upper one of said complementary surfaces having an aperture therein through which the ball can further drop.

3. The game of claim 1 wherein there is included a multiple number of interchangeable principal playing surfaces, each having different sets of targets mounted thereon, each set designed to illustrate in conjunction with one or more of said complementary playing elements certain geometrical relationships and/or figures.

4. The game of claim 1 wherein said support frame is basically rectangular in shape and wherein there is further included peripheral sides extending up along three edges of said principal playing surface element forming side and back-stops against which the balls are rolled.

5. The game of claim 4 wherein said support frame has at least one set of ledges along at least two of its opposing inner sides upon which said complementary playing elements are supported, the fourth side of said frame being removable to expose at least the fourth edge of said complementary elements for easy removal and changing thereof.

6. The game of claim 5 wherein the removable fourth side comprises a removable wall which also serves as a ball receiving and holding tray.

7. The game of claim 1 wherein there is further included an accessory item comprising a back-stop strip which can be placed on said principal playing surface element blocking at least a portion of said peripheral sides changing the paths which a ball will take when rolled across said principal playing surface element.

8. The game of claim 7 where said strip is curved.

9. The game of claim 7 wherein said strip is straight.

* * * * *